US007081899B2

(12) United States Patent
Shimazaki et al.

(10) Patent No.: US 7,081,899 B2
(45) Date of Patent: Jul. 25, 2006

(54) IMAGE PROCESSING SUPPORT SYSTEM, IMAGE PROCESSING DEVICE AND IMAGE DISPLAY DEVICE

(75) Inventors: Hiroaki Shimazaki, Katano (JP); Kenjirou Tsuda, Hirakata (JP); Kunihiko Sakoda, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 502 days.

(21) Appl. No.: 10/417,203

(22) Filed: Apr. 17, 2003

(65) Prior Publication Data

US 2003/0197709 A1 Oct. 23, 2003

(30) Foreign Application Priority Data

Apr. 19, 2002 (JP) ..... 2002-117251

(51) Int. Cl.
*G09G 5/02* (2006.01)
*G09G 5/10* (2006.01)

(52) U.S. Cl. ..... 345/590; 345/589; 345/591; 345/690

(58) Field of Classification Search ..... 345/589–591, 345/601, 602, 690; 348/254, 674; 358/518, 358/519, 523; 382/167
See application file for complete search history.

(56) References Cited

U.S. PATENT DOCUMENTS 5,867,286 A * 2/1999 Lee et al. ..... 358/523
5,987,167 A * 11/1999 Inoue ..... 382/167
6,271,891 B1 * 8/2001 Ogawa et al. ..... 348/674

FOREIGN PATENT DOCUMENTS

JP 10-243259 9/1998
JP 11-146232 5/1999
JP 2002-117251 4/2002

* cited by examiner

*Primary Examiner*—Kee M. Tung
*Assistant Examiner*—Hau Nguyen
(74) *Attorney, Agent, or Firm*—Wenderoth, Lind & Ponack, L.L.P.

(57) ABSTRACT

An image processing support system has an image processing support device that includes a parameter calculating unit for calculating parameters on the basis of results of measurements made by a measuring device and target values notified by a target setting unit. The image processing support system also has an image processing device that includes an image signal processing unit for performing image signal processing such as inverse gamma correction, color conversion, and gamma correction on the basis of the parameters which are an inverse gamma correction parameter, a color conversion parameter, and an gamma correction parameter stored in a parameter storing unit. Further, the image processing support system has a display device for displaying an image signal.

7 Claims, 13 Drawing Sheets

IMAGE PROCESSING SUPPORT SYSTEM, IMAGE PROCESSING DEVICE AND IMAGE DISPLAY DEVICE

BACKGROUND OF THE INVENTION (1) Field of the Invention

The present invention relates to an image processing support system, an image processing device and an image display device for correcting the characteristics of a display panel by performing processes for an inputted image signal so as to display the processed image signal as a visually satisfactory image in portable display apparatuses, such as a notebook personal computer, a PDA and the like.

(2) Description of the Related Art

With the improvement in the performance of personal computers (to be referred to as "PC(s)" hereinafter), an increased number of image signals have been handled in recent years by PCs via digital video/versatile discs (to be referred to as "DVD(s)" hereinafter), networks and the like. Such trend applies not only to desktop PCs, but also to portable notebook PCs. Furthermore, some personal digital assistants (to be referred to as "PDA(s)" hereinafter) which are smaller in size than notebook PCs also handle image signals these days.

However, since PCs are not originally intended for handling image signals, there is a fact that they are inferior to image display apparatuses including the television in terms of the image quality that they can offer. Images that notebook PCs can provide, in particular, are lacking brightness, colorfulness, and vividness due to reasons stemming from power consumption constraints, including that the backlighting of a liquid crystal panel used as a display device cannot be brightened much and that the color filter cannot be darkened as required because the brightness needs to be ensured while saving power consumption.

Under these circumstances, a satisfactory image quality for display is generally obtained by an image processing device that processes an input image signal and outputs such processed signal to a liquid crystal panel. In so doing, existing image processing support systems and image processing devices acquire an image signal, such as an RGB signal and a YIQ signal, and perform processes such as color correction and gamma correction for the image signal so as to carry out optical correction for a video camera, as well as nonlinearity correction for a display device and the like.

As examples of such image processing support systems and image processing devices for performing color correction, gamma correction and other processes, there exist an image processing support system and an image processing device, wherein the image processing device with a processor configuration such as that of a DSP (digital signal processor), for example, performs processing for an inputted image signal using software and an image processing support device (e.g., a personal computer) prepares a program executed on the DSP (Refer to Japanese Laid-Open Patent Application No.H10-243259 as an example).

There also exists another image processing device capable of improving visibility when low-brightness images, such as a scene including darkness in movie software and the like are reproduced, not only by performing gamma correction for an image signal in a gamma correction circuit, but also by raising input brightness levels at around white 25% or below, without correcting input brightness levels at or over white 50% (Refer to Japanese Laid-Open Patent Application No.H11-146232 as an example).

However, since such existing image processing support system and image processing devices are configured to perform processing in stationary apparatuses, it is difficult for them to be employed by portable devices, given such issues as power consumption and the scale of a device. Furthermore, since uniform processing is performed for an image signal without taking into account the characteristics of a display device, there is a problem that image quality of a sufficient level cannot be obtained.

Moreover, when a DSP is used as an image processing device and a program executed on such DSP is prepared in an image processing support system, there arises a problem that battery life is shortened and that a heavy battery with a large power capacity is required, when considering an object of achieving a colorful display screen by aggressively performing color enhancement for display devices with poor color reproducibility, such as liquid crystal panels employed by portable display devices including notebook personal computers and PDAs, since the DSP has drawbacks in terms of power consumption.

Furthermore, when changing the amount of correction to be made in gamma correction and other processes for an input brightness level simply on the basis of a fixed value, it is possible to determine a suitable fixed value used as a reference of correction depending on a display device, if only a specified type of display devices are employed. However, when a single image processing device needs to support multiple types of display devices, there is a possibility that image quality of a sufficient level cannot be achieved since a value suitable for the actual characteristics of a display device is not necessarily obtained.

The present invention has been conceived in view of the aforementioned problems, and it is an object of this invention to provide an image processing support system and an image processing device that are suited to be incorporated into a portable display device in terms of power consumption and the scale of a device, and that allow, even when more than one type of display devices are used, each of such display devices to have optimal brightness/color correction and enhancement, as well as allowing volume production of display apparatuses which incorporate such a display device and an image processing device as a set.

SUMMARY OF THE INVENTION

In order to achieve the above object, the image processing support system according to the present invention is an image processing support system comprising: an image processing device that includes a nonvolatile parameter storing unit operable to store parameters which are set from outside the image processing device, and an image signal processing unit operable to perform signal processing for changing brightness and colors of an input image signal on the basis of the parameters stored in the parameter storing unit and output the processed image signal; a display device for displaying the processed image signal outputted from the image processing device; a measuring device for measuring a gamma characteristic and a color reproduction characteristic of the display device; and an image processing support device for preparing the parameters according to results of measurements made by the measuring device and an operation input from an operator, and setting the prepared parameters in the image processing device.

Accordingly, once the parameters are set by the image processing support device, the image processing device can carry out signal processing on its own, without requiring the image processing support device to perform the writing of parameters when the power is turned on.

Furthermore, in the image processing support system according to the present invention, the image processing support device includes: a receiving unit operable to receive the measurement results from the measuring device; a target characteristic setting unit operable to set a target characteristic; an image signal outputting unit operable to output an evaluation image on the display device via the image processing device; and a parameter calculating unit operable to determine a gamma correction characteristic and a color correction characteristic of the display device according to the measurement results received by the receiving unit, prepare the parameters that realize a characteristic in which partial enhancement or partial control is performed for the gamma correction characteristic and the color correction characteristic depending on the target characteristic set by the target characteristic setting unit, and set the prepared parameters in the image processing device.

Accordingly, it is possible for the image processing support device to set parameters in the image processing device for performing optimal brightness/color correction and enhancement and others for the display device.

Also, the image processing support system according to the present invention is an image processing support system comprising: an image processing device for performing signal processing for changing brightness and colors of an input image signal on the basis of parameters which are set from outside the image processing device, and outputting the processed image signal to a display device; and an image processing support device for preparing the parameters and setting the prepared parameters in the image processing device, wherein the image processing device includes: a parameter storing unit operable to store an inverse gamma correction parameter, a color conversion parameter, and a gamma correction parameter which are the parameters set by the image processing support device; an inverse gamma correcting unit operable to perform an inverse gamma correction process for the input image signal on the basis of the inverse gamma correction parameter so as to reproduce a linear characteristic, and perform partial enhancement or partial control of brightness for the input image signal, a color converting unit operable to perform a color space correction, and partial enhancement or partial control of colors for the signal inputted from the inverse gamma correcting unit on the basis of the color conversion parameter, and output the processed signal indicating a value ranging from a negative value to a value exceeding a maximum level of the input image signal, as an output signal; and a gamma correcting unit operable to perform a correction of a gamma characteristic of the display device for the output signal from the color converting unit which indicates the value ranging from a negative value to a value exceeding the maximum level of the input image signal, on the basis of the gamma correction parameter, and output the processed signal, and the image processing support device calculates an inverse gamma correction parameter which realizes a characteristic in which an output level corresponding to a low input level is higher than an output level of an inverse characteristic of a display device characteristic, when calculating the inverse gamma correction parameter, and calculates a gamma correction parameter which enables a high input level to have a saturation characteristic in an output level direction so that the output signal from the gamma correcting unit corresponding to the high input level can be at or below the maximum level of the input image signal.

Accordingly, it is possible for the image processing support device to set parameters in the image processing device for performing optimal brightness/color correction and enhancement and others for the display device, as in the above case. Moreover, the image processing device is also capable of storing the parameters which have been set, and performing signal processing including brightness/color correction and enhancement and others that best suit the characteristic of the display device, on the basis of such parameters.

Furthermore, the image displaying device according to the present invention is an image displaying device comprising: a processor for executing software; and an image processing device for performing signal processing for changing brightness and colors of an input image signal on the basis of parameters which are set from outside the image processing device, and outputting the processed image signal to a display device, wherein the processor performs an inverse gamma correction process for the input image signal using the software, and outputs the processed signal to the image processing device, and the image processing device includes: a parameter storing unit operable to store a color conversion parameter and a gamma correction parameter which are the parameters set from outside the image processing device; a color converting unit operable to perform a color space correction, and partial enhancement or partial control of colors for the signal inputted from the processor on the basis of the color conversion parameter, and output the processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from a negative value to a value exceeding the maximum level of the input image signal, on the basis of the gamma correction parameter, and output the processed signal to the display device.

Accordingly, since a color conversion process and others involving a large amount of processing when performed on the processor can be carried out in the image processing device, and an inverse gamma correction process can be performed on the processor using software, it is possible to make reductions in the amount of power consumption and in the size of an area required for implementing the image processing device, while controlling to reduce the amount of processing to be performed in the processor.

Moreover, the image processing device according to the present invention is an image processing device for performing signal processing for changing brightness and colors of an input image signal on the basis of parameters which are set from outside the image processing device, and outputting the processed image signal to a display device; the image processing device comprising: a parameter storing unit operable to store an inverse gamma correction parameter, a color conversion parameter and a gamma correction parameter which are the parameters set from outside the image processing device; a color converting unit operable to perform a color space correction, and partial enhancement or partial control of colors for the input image signal on the basis of the color conversion parameter, and output the processed signal indicating a value ranging from a negative value to a value exceeding a maximum level of the input image signal, as an output signal; a gamma correcting unit operable to perform a correction, and partial enhancement or partial control of a gamma characteristic of the display device for the output signal from the color converting unit which indicates the value ranging from a negative value to a value exceeding the maximum level of the input image signal, on the basis of the gamma correction parameter, and output the processed signal to the display device; and an external interface unit operable to read the inverse gamma correction parameter from the parameter storing unit and output the readout parameter to outside the image processing device.

Accordingly, a collective management of parameters becomes possible even when an inverse gamma correction process is carried out outside the image processing device, which facilitates parameter management in the case where the image processing device is produced in quantity.

Also, the image processing device according to the present invention is an image processing device for performing signal processing for changing brightness and colors of an input image signal on the basis of parameters which are set from outside the image processing device, and outputting the processed image signal to a display device; the image processing device comprising: a parameter storing unit operable to store an inverse gamma correction parameter, a color conversion parameter and a gamma correction parameter which are the parameters set from outside the image processing device; an inverse gamma correcting unit operable to perform an inverse gamma correction process for the input image signal on the basis of the inverse gamma correction parameter so as to reproduce a linear characteristic; a color converting unit operable to perform a color space correction, and partial enhancement or partial control of colors for the signal inputted from the inverse gamma correcting unit, on the basis of the color conversion parameter, and output the processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from a negative value to a value exceeding the maximum level of the input image signal, on the basis of the gamma correction parameter, and output the processed signal to the display device.

Accordingly, it is possible for the image processing device to store the parameters which have been set, and perform signal processing including brightness/color correction and enhancement and others that best suit the characteristic of the display device, on the basis of such parameters.

Moreover, the image processing support system according to the present invention is an image processing support system comprising: an image processing support device that includes a processor for executing software and a recording medium that stores image processing software for performing signal processing for changing brightness and colors of an input image signal on the processor and outputting the processed image signal; a display device for displaying the image signal which has been outputted after the signal processing by the image processing software on the processor; and a measuring device for measuring a gamma characteristic and a color reproduction characteristic of the display device, wherein the image processing support device prepares parameters according to results of measurements made by the measuring device and an operation input from an operator, and executes the image processing software on the processor using the parameters.

Accordingly, since signal processing for changing brightness and colors can be carried out on the processor using the image processing software, an advantage in terms of both power consumption and an area required for implementing the image processing system can be achieved, and modifications to the contents of image processing can be made without much restraint. Furthermore, it is also possible to perform signal processing including brightness/color correction and enhancement and others that best suit the characteristic of the display device.

Note that not only is it possible to embody the present invention as an image processing support system and an image processing device with the above configuration, but also as an image processing support method and an image processing method that include as their steps characteristic units of the image processing support system and the image processing device according to the present invention, and as a program which has a computer execute such steps. It should be also understood that such program can be distributed via a recording medium, including CD-ROM and the like, as well as via a transmission medium including the internet and the like.

As further information about the technical background to this application, Japanese patent application No. 2002-117251 filed Apr. 19, 2002 is incorporated herein by reference.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENT

The following explains the preferred embodiment of the present invention with reference to the figures.

Figure 1:
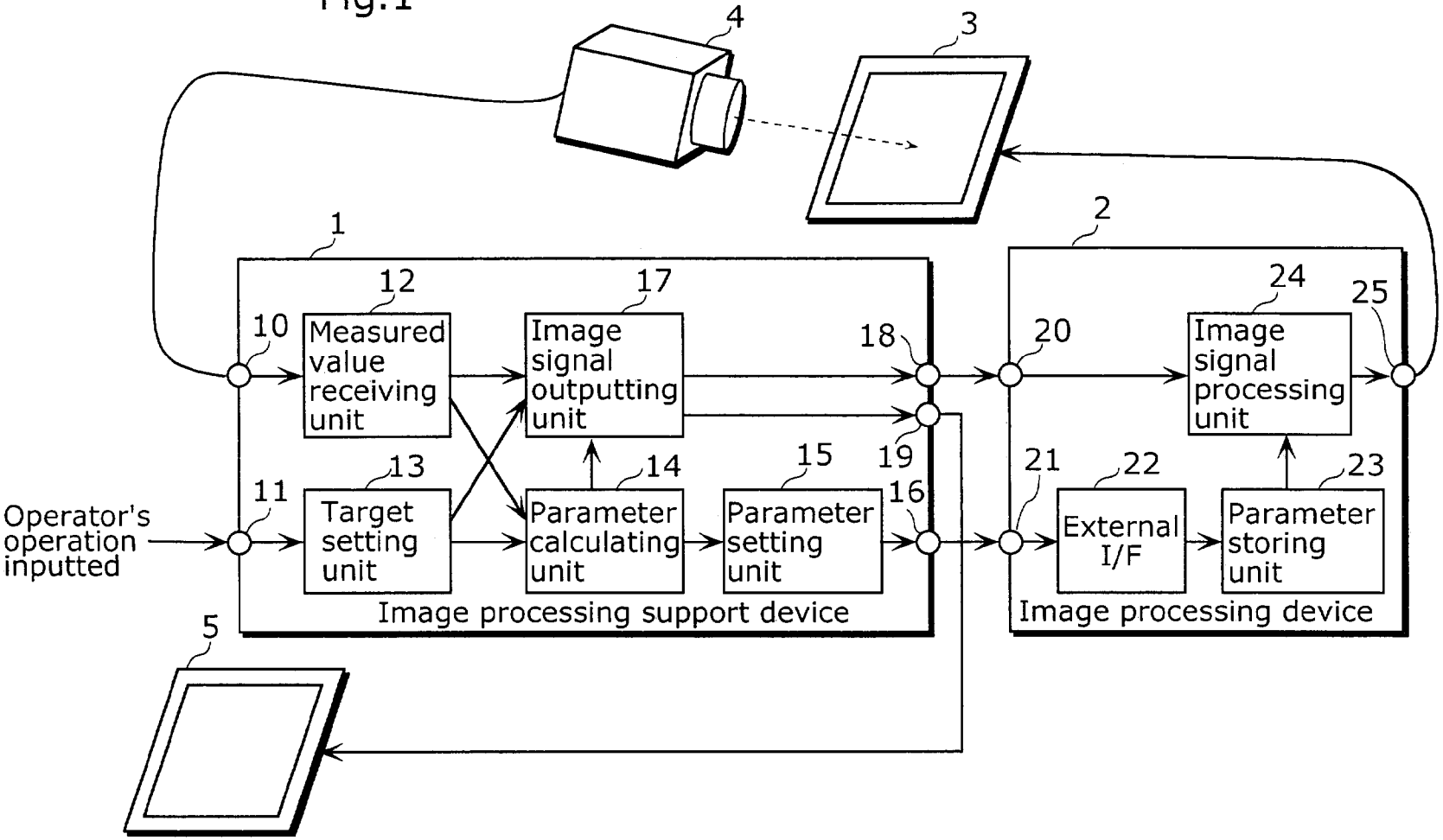
FIG. 1 is a block diagram showing a configuration of an image processing support system according to the preferred embodiment of the present invention.

FIG. 1 is a block diagram showing the configuration of an image processing support system according to the preferred embodiment of the present invention.

Such image processing support system, which is a system for making adjustments to signal processing parameters used by an image processing device 2 for a display device 3, is comprised of an image processing support device 1, the image processing device 2, the display device 3, a measuring device 4, and an operation screen display device 5, as illustrated in FIG. 1.

The image processing support device 1 is comprised of input terminals 10 and 11, a measured value receiving unit 12, a target setting unit 13, a parameter calculating unit 14, a parameter setting unit 15, an output terminal 16, an image signal outputting unit 17, and output terminals 18 and 19.

The image signal outputting unit 17 outputs measurement image signals for measuring the gamma characteristic and color reproducibility of the display device 3. The measured value receiving unit 12 receives measurement results from the measuring device 4 via the input terminal 10, and stores the received results. The target setting unit 13 notifies the parameter calculating unit 14 and the image signal outputting unit 17 of target values which an operator has inputted via the input terminal 11. The parameter calculating unit 14 calculates parameters on the basis of the measurement results notified by the measured value receiving unit 12 and the target values notified by the target setting unit 13. The parameter setting unit 15 outputs such parameters to the image processing device 2 via the output terminal 16.

The image processing device 2 is comprised of input terminals 20 and 21, an external interface 22, a parameter storing unit 23, an image signal processing unit 24, and an output terminal 25.

The parameter storing unit 23 stores an inverse gamma correction parameter, a color conversion parameter, a gamma correction parameter and the like. The image signal processing unit 24 performs image signal processes such as inverse gamma correction, color conversion and gamma correction for the inputted image signal, on the basis of each of the parameters stored in the parameter storing unit 23.

First, an explanation is given for the operation for measuring the gamma characteristic and color reproducibility of the display device 3 in the image processing support system with the above configuration.

The image signal outputting unit 17 of the image processing support device 1 outputs measurement image signals for measuring the gamma characteristic and color reproducibility of the display device 3. Such measurement image signals are outputted to the display device 3 via the image processing device 2, but it is necessary that processes including gamma correction and color enhancement shall not be performed by the image processing device 2 while measurement is ongoing. For this reason, the parameter calculating unit 14 of the image processing support device 1 prepares such measurement parameters as make the image signal processing unit 24 not perform signal processes such as gamma correction and color enhancement for the input signals from the input terminal 20 so that such input signals can be delivered to the output terminal 25 as source signals. The parameter setting unit 15 outputs the measurement parameters prepared by the parameter calculating unit 14 to the image processing device 2 via the output terminal 16. Such measurement parameters are inputted to and stored in the parameter storing unit 23 via the input terminal 21 and the external interface 22. The parameter storing unit 23 provides such stored measurement parameters to the image signal processing unit 24.

The measuring device 4 measures the brightness and color of the measurement image signals displayed on the display device 3, and outputs the measurement results to the image processing support device 1. The measured value receiving unit 12 receives and stores the measurement results inputted to the input terminal 10 of the image processing support device 1.

As measurement image signals outputted by the image signal outputting unit 17, a plurality of image signals such as signals for monochrome display (e.g., whole red, green or blue) and signals for monochrome display of a plurality of gray levels are switched and used. In order to synchronize the switching of measurement image signals with the measuring operation of the measuring device 4, the measured value receiving unit 12, on the receipt of the measurement results from the measuring device 4, outputs to the image signal outputting unit 17 a reception notification signal indicating that it received the measurement results. The image signal outputting unit 17 makes a switch of measurement image signals after receiving such reception notification signal.

By repeating the aforementioned operation, characteristic data, such as the gamma characteristic, color reproducibility and the like of the display device 3, is stored in the measured value receiving unit 12.

Figure 2:
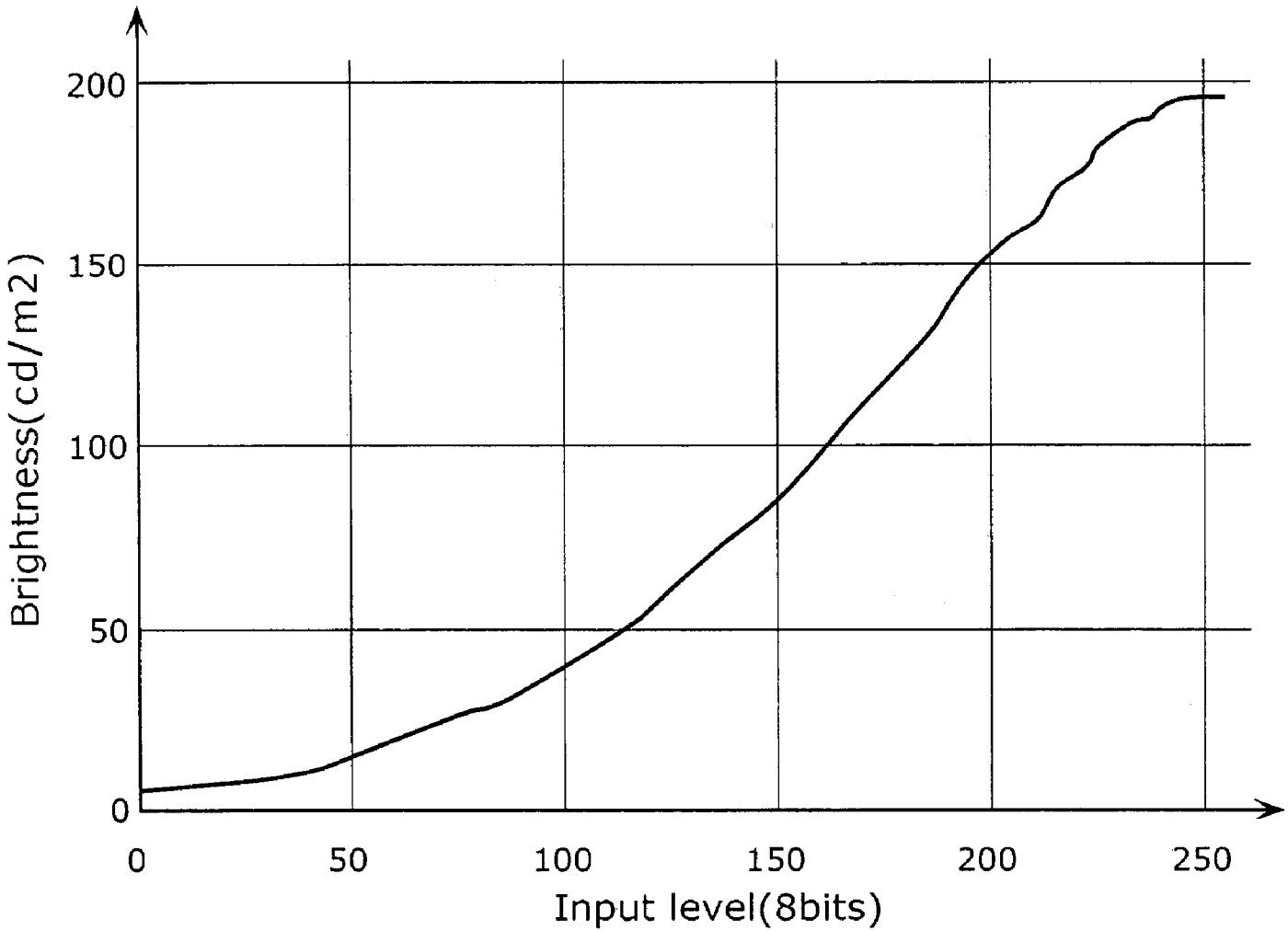
FIG. 2 is a diagram showing an example result of measuring the gamma characteristic of a display device.
Figure 3:
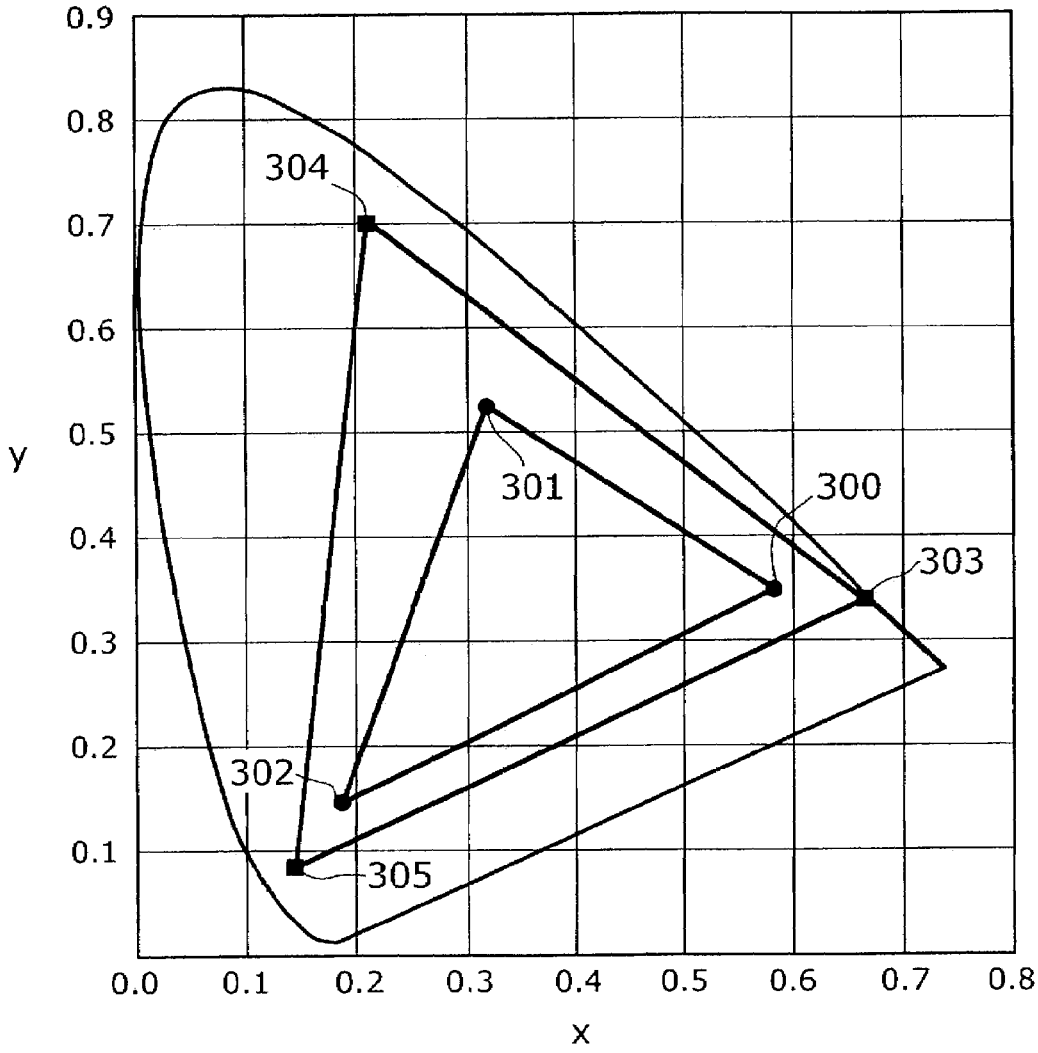
FIG. 3 is a diagram showing an example result of measuring the color reproducibility of the display device.

FIG. 2 is a diagram showing an example result of measuring the gamma characteristic of the display device 3, while FIG. 3 is an example result of measuring the color reproducibility of the display device 3. In the present embodiment, the display device 3 receives and displays 8-bit parallel RGB digital signals.

The gamma characteristic of the display device 3 as illustrated in FIG. 2 can be obtained by changing values between achromatic, i.e., monochrome signals (which display on the entire screen a single value as three signals of RGB) of black (R=0, G=0, B=0) and white (R=255, G=255, B=255) as measurement image signals so as to display and make a measurement. The gamma characteristic of a general display device shows a nonlinear characteristic as illustrated in FIG. 2.

Meanwhile, chromaticity indicated by a point R300 shown in FIG. 3 can be obtained by displaying and measuring a signal showing red on the entire screen (R=255, G=0, B=0) as a measurement image signal. Similarly, chromaticity indicated by a point G301 in FIG. 3 is obtained by a signal showing green on the entire screen (R=0, G=255, B=0), and chromaticity indicated by a point B302 in FIG. 3 is obtained by a signal showing blue on the entire screen (R=0, G=0, B=255). Assuming that the display device 3 is a liquid crystal panel and the like used for such a portable display apparatus as a notebook PC, a triangle-shaped area, i.e., color reproducibility, formed by connecting RGB points, is generally smaller than the reproducibility represented by a triangle formed by connecting the point R303, the point G304, and the point B305 in the scope of the NTSC standard. For this reason, when displaying an image signal in conformity with the NTSC standard, for example, a light-colored image is displayed.

Next, a detailed explanation is given for the processing to be performed by the image processing device 2.

Figure 4:
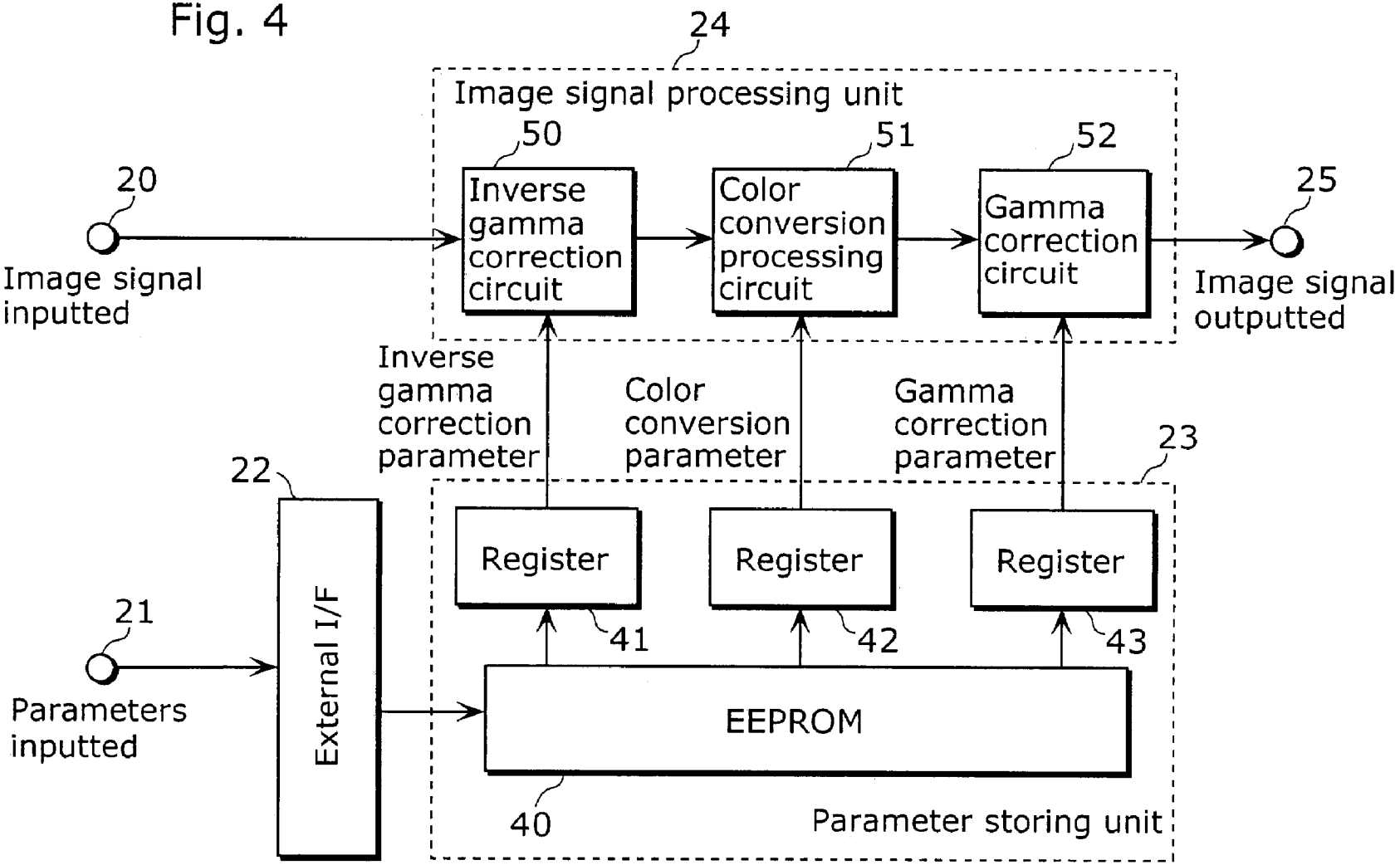
FIG. 4 is a block diagram showing an internal configuration of the image processing device according to the preferred embodiment of the present invention.

FIG. 4 is a block diagram showing the internal configuration of the image processing device 2 according to the preferred embodiment of the present invention. Note that the same numbers are assigned to the same components as those illustrated in FIG. 1.

The parameter storing unit 23 of the image processing device 2 includes an EEPROM 40, and registers 41, 42 and 43. The image signal processing unit 24 includes an inverse gamma correction circuit 50, a color conversion processing circuit 51, and a gamma correction circuit 52.

An explanation is given here by defining the following three parameters as one set of processing parameter handled by the image processing support device 1 and the image processing device 2: inverse gamma correction parameter, color conversion parameter, and gamma correction parameter. The processing parameter inputted from the image processing support device 1 is written to the EEPROM 40 via the external interface 2. The use of the EEPROM (Electrically-Erasable and Programmable ROM) for storing the processing parameter in the image processing device 2 makes it possible for the image processing device 2 to perform image processing in accordance with the once-stored processing parameter, without requiring the input of such processing parameter from the image processing support device 1.

Of the processing parameter written to the EEPROM 40, the register 41 reads out the inverse gamma correction parameter, the register 42 reads out the color conversion parameter, and the register 43 reads out the gamma correction parameter. The inverse gamma correction parameter which has been read out by the register 41 is outputted to the inverse gamma correction circuit 50. Then, on the basis of such inputted inverse gamma correction parameter, the inverse gamma correction circuit 50 performs an inverse gamma correction process for an image signal inputted from the input terminal 20, and outputs the processed image signal to the color conversion processing circuit 51. The color conversion parameter read out by the register 42 is outputted to the color conversion processing circuit 51, which then performs a color conversion process for the image signal inputted from the inverse gamma correction circuit 50, on the basis of the inputted color conversion parameter, and outputs the processed image signal to the gamma correction circuit 52. The gamma correction parameter read out by the register 43 is outputted to the gamma correction circuit 52, which then performs a gamma correction process for the image signal inputted from the color conversion processing circuit 51, on the basis of the inputted gamma correction parameter, and outputs the processed image signal to the output terminal 25.

Figure 5:
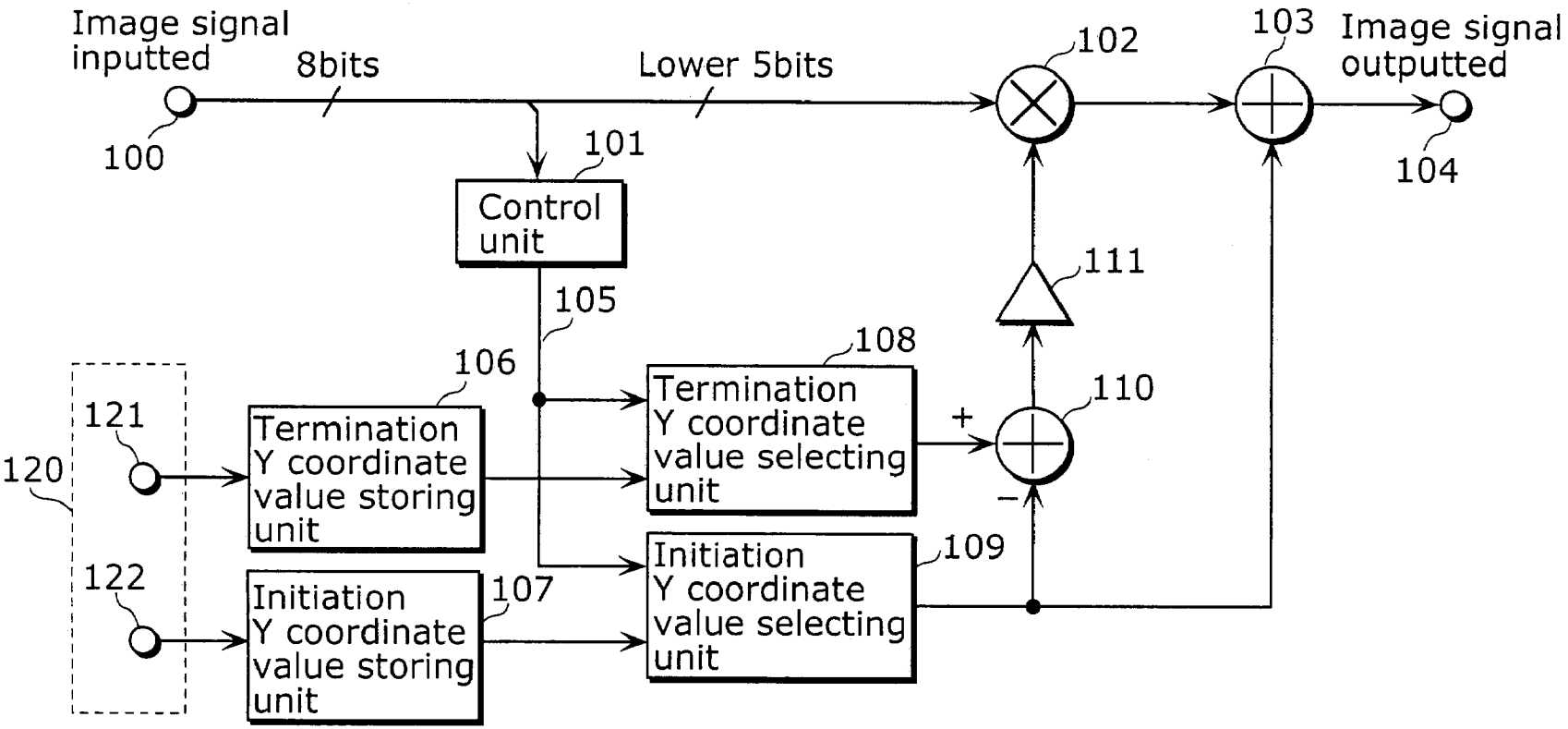
FIG. 5 is a block diagram showing a configuration of an inverse gamma correction circuit.

FIG. 5 is a block diagram showing the configuration of the inverse gamma correction circuit 50.

The inverse gamma correction circuit 50 has an input terminal 100, a control unit 101, a multiplier 102, an adder 103, an output terminal 104, a termination Y coordinate value storing unit 106, an initiation Y coordinate value storing unit 107, a termination Y coordinate value selecting unit 108, an initiation Y coordinate value selecting unit 109, a subtracter 110, a divider 111, a parameter input terminal 120, and input terminals 121 and 122. Note that FIG. 5 is a block diagram showing a circuit in the inverse gamma correction circuit 50 that processes only one signal out of the RGB signals, and therefore that the inverse gamma correction circuit 50 has three circuits for all RGB signals in parallel which are equivalent to the circuit shown in FIG. 5.

In this inverse gamma correction circuit 50, the characteristic of inverse gamma correction is more closely analogous to a broken line divided into eight parts. In other words, an inputted image signal is judged as to which part it belongs to of the eight parts according to the level of such image signal, and processed to be converted into an output value through linear approximate calculation in a part determined in accordance with the result of such judgment.

Figure 6:
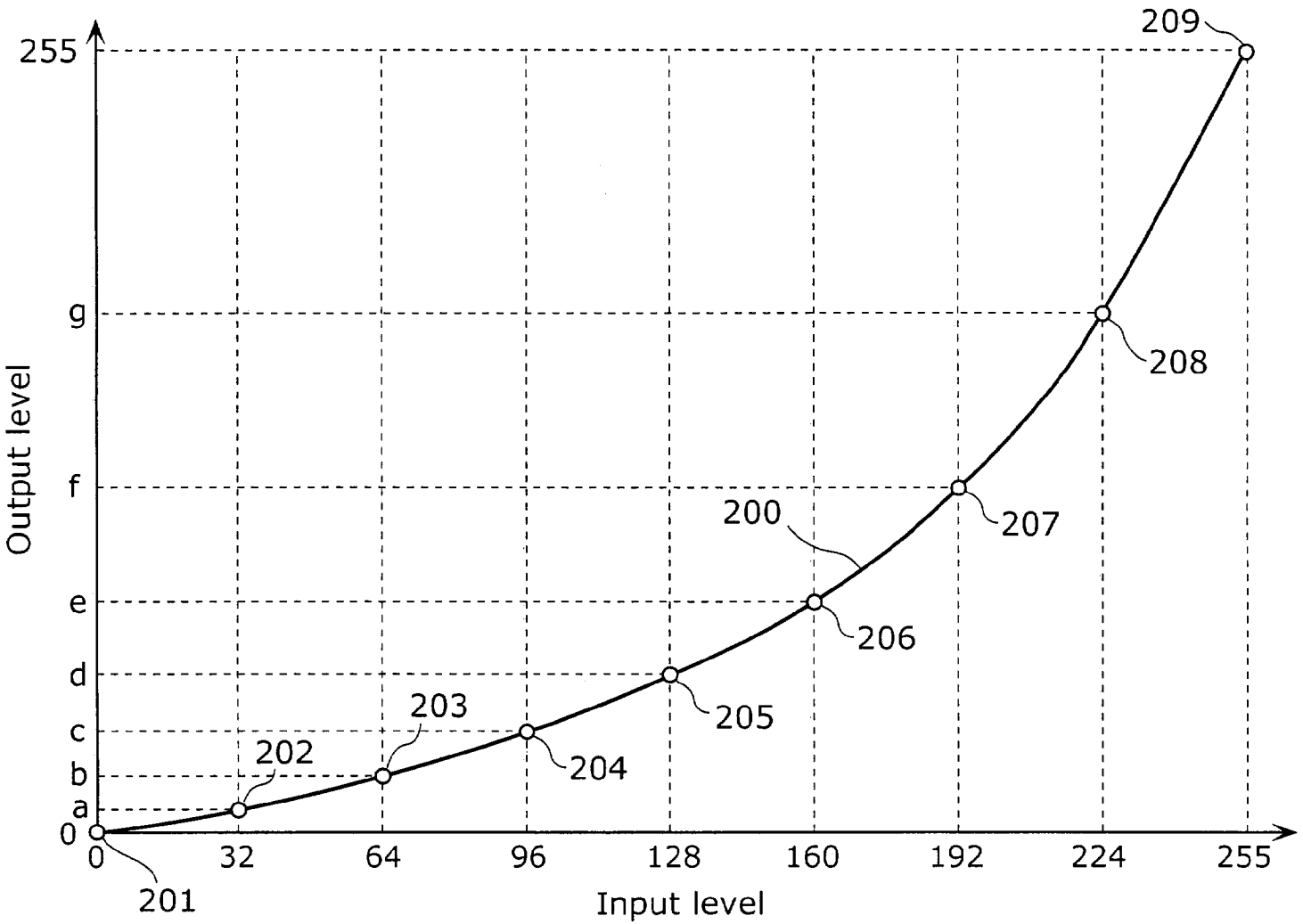
FIG. 6 is a diagram explaining the contents of a correction process in the inverse gamma correction circuit.

FIG. 6 is a diagram explaining the contents of the correction process performed by the inverse gamma correction circuit 50 illustrated in the block diagram of FIG. 5. The horizontal axis indicates the level of an image signal inputted from the input terminal 100, while the vertical axis indicates the level of the image signal outputted from the output terminal 104. Depending on which of the eight parts resulted from dividing the input level for every 32 values (indicated by eight lines: 201–202, 202–203, 203–204, 204–205, 205–206, 206–207, 207–208, and 208–209) such inputted image signal belongs to, an approximation process is performed for the corresponding part. Y axis values corresponding to both edges of each of the eight parts (i.e. 0, a, b, c, d, e, f, g, and 255) are an inverse gamma correction parameter in the present embodiment.

Initiation Y coordinate values of the eight lines, i.e., output level values (0, a, b, c, d, e, f, and g) indicated by break points on the left of each line in FIG. 6 are stored as initiation Y coordinate values by the initiation Y coordinate value storing unit 107 via the input terminal 122. Furthermore, termination Y coordinate values of the eight lines, i.e., output level values (a, b, c, d, e, f, g, and 255) indicated by break points on the right of each line in FIG. 6 are stored as termination Y coordinate values by the termination Y coordinate value storing unit 106 via the input terminal 121.

The 8-bit parallel image signal inputted from the input terminal 100 is divided into the upper 3 bits and the lower 5 bits, and the upper 3 bits are inputted to the control unit 101 and the lower 5 bits are inputted to the multiplier 102 respectively. Using such 3 bit values, the control unit 101 judges which part on the broken line in FIG. 6 the inputted image signal belongs to, and controls the termination Y coordinate value selecting unit 108 and the initiation Y coordinate value selecting unit 109 by the use of a judgment result signal 105 in accordance with the result of such judgment. Under the control of the control unit 101, the termination Y coordinate value selecting unit 108 and the initiation Y coordinate value selecting unit 109 respectively output Y coordinate values indicating both ends of the part which the input image signal belong to, out of the Y coordinate values corresponding to the broken lines stored in the termination Y coordinate value storing unit 106 and the initiation Y coordinate value storing unit 107.

A value indicating the slope of the broken line corresponding to the part which the input image signal belongs to is determined by subtracting by the subtracter 110 the value outputted from the initiation Y coordinate value selecting unit 109 from the value outputted from the termination Y coordinate value selecting unit 108, and further by dividing the resulting value by the fixed value 32 by the divider 111. Such resulting slope value outputted from the divider 111 is outputted to the multiplier 102. The multiplier 102 outputs to the adder 103 a value to be determined by multiplying the slope value from the divider 111 by the lower 5 bits of the input image signal from the input terminal 100, i.e., an offset value on the Y axis derived from the initiation Y coordinate value on the broken line corresponding to the input image signal. The adder 103 adds the inputted offset value with the initiation Y coordinate value on the broken line corresponding to the input image signal inputted from the initiation Y coordinate value selecting unit 109 so as to determine a value of the output level, and outputs the result to the output terminal 104.

Figure 7:
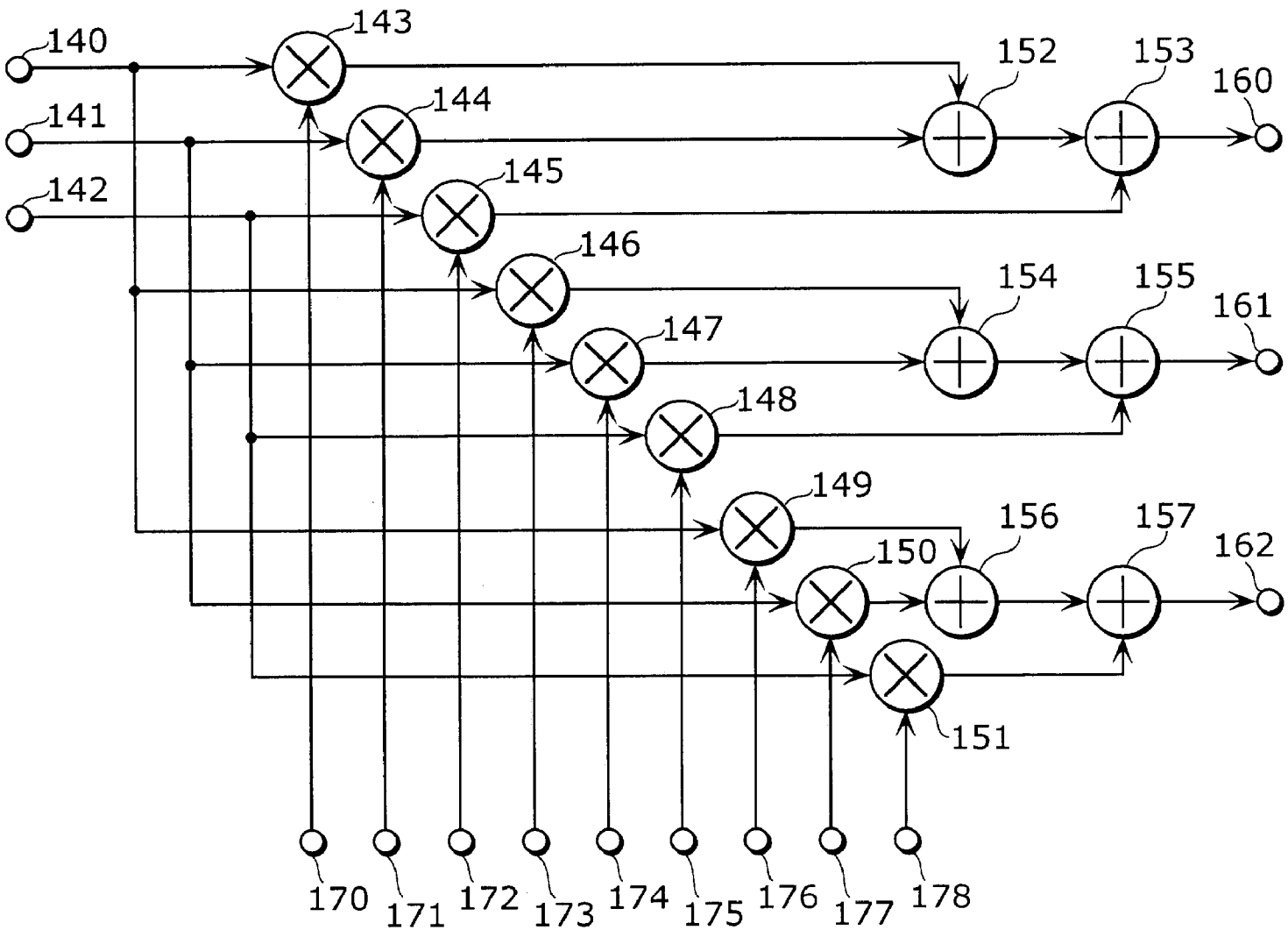
FIG. 7 is a block diagram showing a configuration of a color conversion processing circuit.

FIG. 7 is a block diagram showing the configuration of the color conversion processing circuit 51.

The color conversion processing circuit 51 has input terminals 140, 141, and 142, multipliers 143, 144, 145, 146, 147, 148, 149, 150 and 151, adders 152, 153, 154, 155, 156 and 157, output terminals 160, 161, and 162, and input terminals 170, 171, 172, 173, 174, 175, 176, 177, and 178. Note that FIG. 7 is a diagram depicting all signals of RGB.

The color conversion processing circuit 51 performs a color conversion process for inputted RGB image signals through 3×3 matrix calculation. Assuming that the input RGB signals are respectively R, G, and B, output signals are respectively R', G', and B', and a color conversion parameter consists of A11, A12, A13, A21, A22, A23, A31, A32, and A33, a calculation to be performed in the color conversion processing circuit 51 illustrated in FIG. 7 is represented by the following Expression (1):

$$\begin{pmatrix} R' \\ G' \\ B' \end{pmatrix} = \begin{pmatrix} A11 & A12 & A13 \\ A21 & A22 & A23 \\ A31 & A32 & A33 \end{pmatrix} \begin{pmatrix} R \\ G \\ B \end{pmatrix} \tag{1}$$

Therefore, when the R signal is inputted to the input terminal 140, the G signal to the input terminal 141, and the B signal to the input terminal 142 respectively, the parameter A11 is inputted to the input terminal 170, the parameter A12 to the input terminal 171, the parameter A13 to the input terminal 172, the parameter A21 to the input terminal 173, the parameter A22 to the input terminal 174, the parameter A23 to the input terminal 175, the parameter A31 to the input terminal 176, the parameter A32 to the input terminal 177, and the parameter A33 to the input terminal 178 respectively. As a result of performing calculations for these parameters, the R' signal is outputted to the output terminal 160, the G' signal to the output terminal 161, and the B' signal to the output terminal 162 respectively.

In the present embodiment, what the color conversion processing circuit 51 performs is not only a simple color correction process, but also such processes as color enhancement or color control, as well as hue change. For this reason, a signed color conversion parameter is inputted to the input terminals 170~178 in the color conversion processing circuit 51. Furthermore, each of the RGB image signals to be appearing in the output terminals 160, 161 and 162 is configured so as not to be limited by a limiter to be in the range of 8-bit parallel signals, but configured to be outputted as image signals which are signed and which are extended in their signal ranges. In the following explanation, the color conversion processing circuit 51 has a configuration in which signed 10-bit parallel RGB signals are outputted from the output terminals 160, 161 and 162.

Moreover, the gamma correction circuit 52 can be embodied by employing a circuit with the configuration equivalent to that of the inverse gamma correction circuit 50 illustrated in FIG. 5. Note, however, that since the input image signal has the additional process performed thereon in the color conversion processing circuit 51, some small changes may be required in the configuration, as well as in the contents of parameter calculation. Descriptions in this respect are provided later.

Next, an explanation is given for the operation for calculating parameters in the image processing support device 1 illustrated in FIG. 1.

Figure 8:
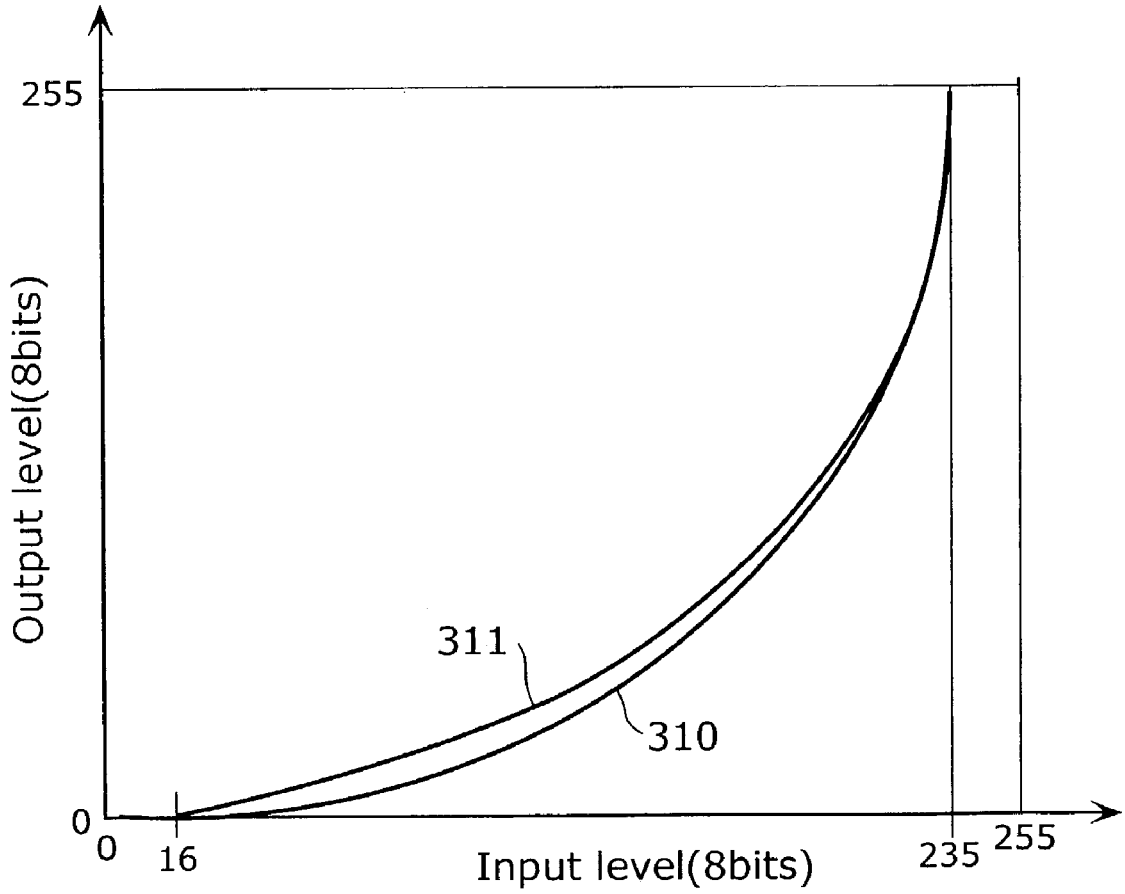
FIG. 8 is a diagram showing an example processing characteristic specified by an inverse gamma correction parameter.

FIG. 8 is a diagram showing an example processing characteristic specified by the inverse gamma correction parameter. Assuming that an image signal to be inputted is such an image signal as an NTSC-compliant image signal for which receiver's gamma correction is performed in advance on the part of a video camera, it is necessary for the inverse gamma correction circuit 50 to calculate the inverse characteristic of such receiver's gamma correction characteristic in order to obtain a linear signal. Accordingly, the parameter calculating unit 14 calculates an inverse gamma correction parameter which has the inverse gamma characteristic represented by a curve 310 illustrated in FIG. 8.

Regarding the calculation performed by the parameter calculating unit 14, since the characteristics of the display device do not have a direct influence on the inverse gamma correction characteristic, all that is required is to calculate the inverse characteristic of the NTSC-compliant receiver's gamma correction characteristic as an inverse gamma correction parameter, and the result of such calculation is just required to be stored as a fixed value. For example, letting an input signal and an output signal of the inverse gamma correction circuit 50 be Xg and Yg respectively, the curve 310 in FIG. 8 can be determined using the following Expression (2):

When Xg<16,

Yg=0

When 16≦Xg≦235, $Yg=255\times((Xg-16)/(235-16))^{**}(1/2.2)$

When 235<Xg,

Yg=255 (2)

Note that "**" indicates an exponential calculation in this specification.

In other words, the parameter calculating unit 14 determines, by the use of the above Expression (2), an inverse gamma correction parameter which indicates Y axis values corresponding to both ends of the eight parts resulted from dividing the input level for every 32 levels as explained above.

Such parameter calculating unit 14 can be easily embodied by employing a microcomputer as hardware, for example, and implementing Expression (2) on software to be executed on such microcomputer. Or, since the value of Xg is fixed in the inverse gamma correction circuit 50 illustrated in FIG. 5, it is also possible that the parameter calculating unit 14 stores a value for Yg that corresponds to the value of Xg to be determined using Expression (2).

Moreover, in order to improve visibility in content, such as a movie that includes many dark scenes, it is possible to set a part indicating a low input level slightly higher as represented by the curve 311 in FIG. 8. Such curve 311 can be calculated by adding a certain brightness enhancement coefficient to a low input level part when calculating parameters. For example, Expression (2) can be changed as follows ("**" indicates an exponential operation):

When Xg<16,

Yg=0

When $16 \leqq Xg < 2 \times B$, $$Yg = 255 \times ((Xg-16)/(235-16)^{**}(1/2.2)) + A \times (1-\cos(\pi((Xg-16)/B)))$$

When $2 \times B \leqq Xg \leqq 235$, $$Yg = 255 \times ((Xg-16)/(235-16)^{**}(1/2.2))$$

When $235 < Xg$, $$Yg = 255 \quad (3)$$

Using Expression (3), the parameter calculating unit 14 can calculate an inverse gamma correction parameter resulted from enhancing only the maximum level A of the original inverse gamma correction characteristic, with (Xg−16)=B as the peak. The parameter calculating unit 14 is also capable of displaying a graph generated by the use of Expression (3) on the operation image display device 5 via the image signal outputting unit 17 so as to make an adjustment to values corresponding to A and B in Expression (3) in accordance with an operator's input.

Figure 9:
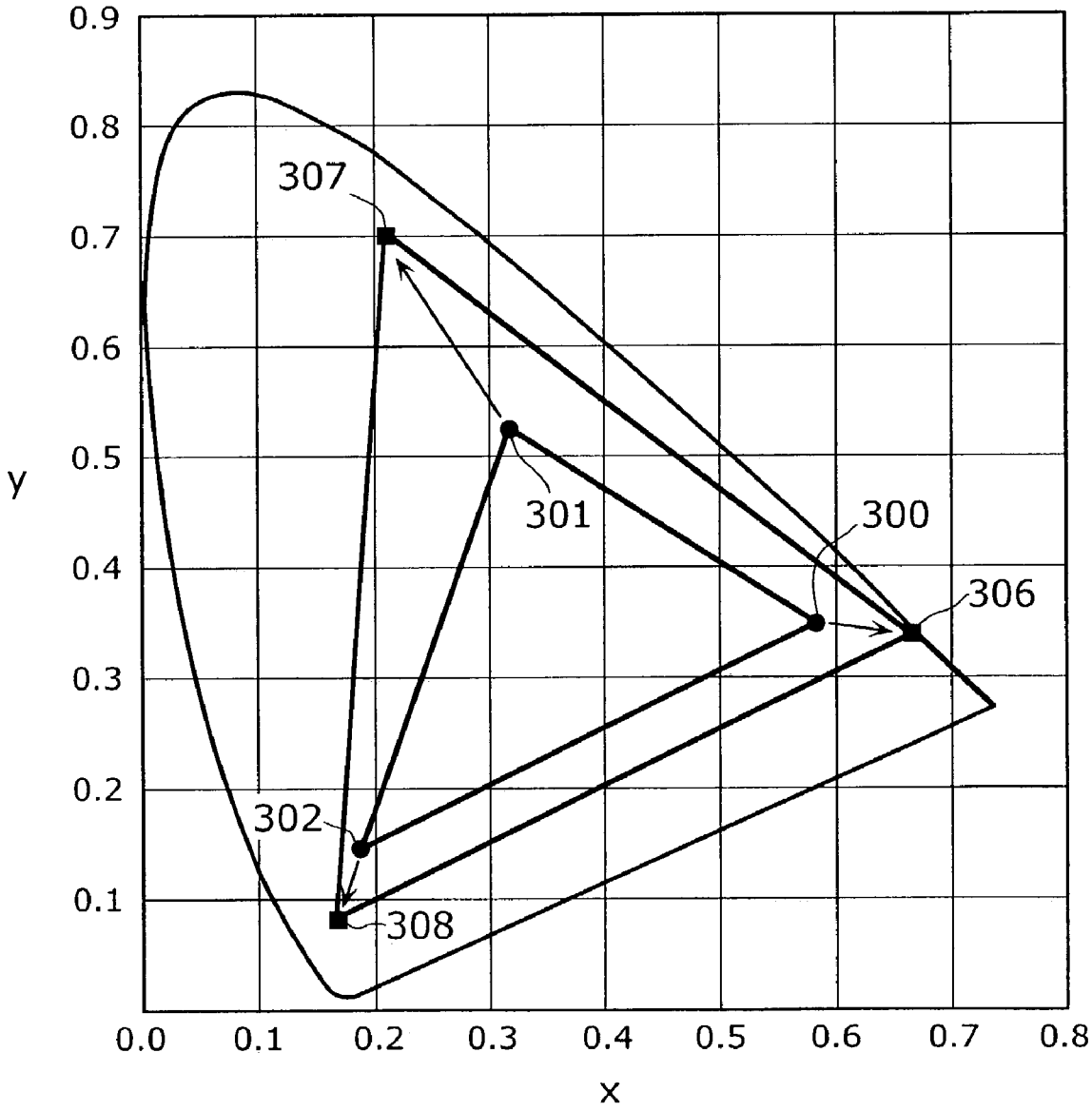
FIG. 9 is a diagram showing an example processing characteristic specified by a color conversion parameter.

FIG. 9 is a diagram showing an example processing characteristic specified by the color conversion parameter.

The point R300, the point G301, and the point B302 on the xy chromaticity diagram form a triangle indicating the color reproducibility of the display device 3 measured by following the aforementioned procedure. Meanwhile, a point R306, a point G307, and a point B308 are chromaticity points indicating the target color reproducibility to be obtained. Note that the chromaticity points R306, G307, and B308 indicating the color reproducibility to be obtained are not necessarily identical with the chromaticity points R303, G304 and B305 indicating the color reproducibility of the NTSC standard illustrated in FIG. 3.

The color conversion processing circuit 51 performs processing for increasing the amplitude of the color signals so as to approximate the point R300 to the point R306, the point G301 to the point G307, and the point B302 to the point B308, respectively, in a pseudo manner as indicated by the arrows in the FIG. 9. However, since it does not mean that the color reproducibility of the display device 3 itself is expanded, an image on the display device 3 is displayed with its color being saturated within the triangle formed by the points R300, G301 and B302. Neutral colors, on the other hand, are displayed vividly, and therefore, an appropriate setting of a color conversion parameter enables color saturation to be minimized and therefore the image to be displayed vividly.

Accordingly, it is necessary to make an appropriate selection of the color chromaticity points R306, G307 and B308 indicating the color reproducibility to be obtained and to display the image which has been actually processed by the color conversion processing circuit 51 on the display device 3 so as to make an adjustment to the target color reproducibility while checking the image quality. The image processing support system according to the present embodiment is well capable of supporting such requirement.

Processing to be actually performed by the color conversion processing circuit 51 in the present embodiment is a calculation presented as Expression (1). The following describes a parameter calculation method for carrying out a process corresponding to the aforementioned explanation given with reference to FIG. 9.

The input/output signals in Expression (1) are RGB signals, but since FIG. 9 shows an xy chromaticity chart, conversion to be conducted in this respect needs to be taken into consideration. A description is provided here for processing for mapping chromaticity points in the case where the input signals are displayed as they are on the color reproducibility range of the display device 3 over the chromaticity points on the target color reproducibility range. Letting the chromaticity of a certain color in the color reproducibility range of the display device 3 be x, y, and z, tristimulus values X, Y, and Z in the X Y Z system are, $$X = xS, Y = yS, Z = zS \quad (4).$$

Note, however, that S=X+Y+Z

Meanwhile, letting the chromaticity of the corresponding color in the target color reproducibility range be x', y' and z', tristimulus values X', Y', and Z' in the X Y Z system are, $$X' = x'S', Y' = y'S', Z' = z'S' \quad (5).$$

Note, however, that S'=X'+Y'+Z'

The conversion from the XYZ tristimulus values to RGB tristimulus values is conducted using the following expression:

$$\begin{pmatrix} R \\ G \\ B \end{pmatrix} = \begin{pmatrix} 0.4184 & -0.1586 & -0.0828 \\ -0.0912 & 0.2524 & 0.0157 \\ 0.0009 & -0.0026 & 0.1786 \end{pmatrix} \begin{pmatrix} X \\ Y \\ Z \end{pmatrix} \quad (6)$$

For example, assuming that the xy chromaticity of each of the RGB chromaticity points when the input signals are directly displayed on the color reproducibility range of the display device 3 are R(Rx, Ry, Rz), G(Gx, Gy, Gz) and B(Bx, By, Bz), the following expression (7) resulting from Expressions (1), (4), (5) and (6) is used to determine a color conversion parameter used to adjust them to the xy chromaticity of each of the RGB chromaticity points R'(Rx', Ry', Rz'), G'(Gx', Gy', Gz') and B'(Bx', By', Bz') in the target color reproducibility range:

$$\begin{pmatrix} A11 & A12 & A13 \\ A21 & A22 & A23 \\ A31 & A32 & A33 \end{pmatrix} = \begin{pmatrix} 0.4184 & -0.1586 & -0.0828 \\ -0.0912 & 0.2524 & 0.0157 \\ 0.0009 & -0.0026 & 0.1786 \end{pmatrix} \begin{pmatrix} Rx' & Gx' & Bx' \\ Ry' & Gy' & By' \\ Rz' & Gz' & Bz' \end{pmatrix} \left( \begin{pmatrix} 0.4184 & -0.1586 & -0.0828 \\ -0.0912 & 0.2524 & 0.0157 \\ 0.0009 & -0.0026 & 0.1786 \end{pmatrix} \begin{pmatrix} Rx & Gx & Bx \\ Ry & Gy & By \\ Rz & Gz & Bz \end{pmatrix} \right)^{-1} \quad (7)$$

Using the above Expression (7), the parameter calculating unit 14 determines a color conversion parameter (A11, A12, A13, A21, A22, A23, A31, A32 and A33) used to convert each of the chromaticity points of the display device 3 R(Rx, Ry, Rz), G(Gx, Gy, Gz) and B(Bx, By, Bz) into the chromaticity points R'(Rx', Ry', Rz'), G'(Gx', Gy', Gz') and B'(Bx', By', Bz') adjusted to the target color reproducibility range.

Figure 10:
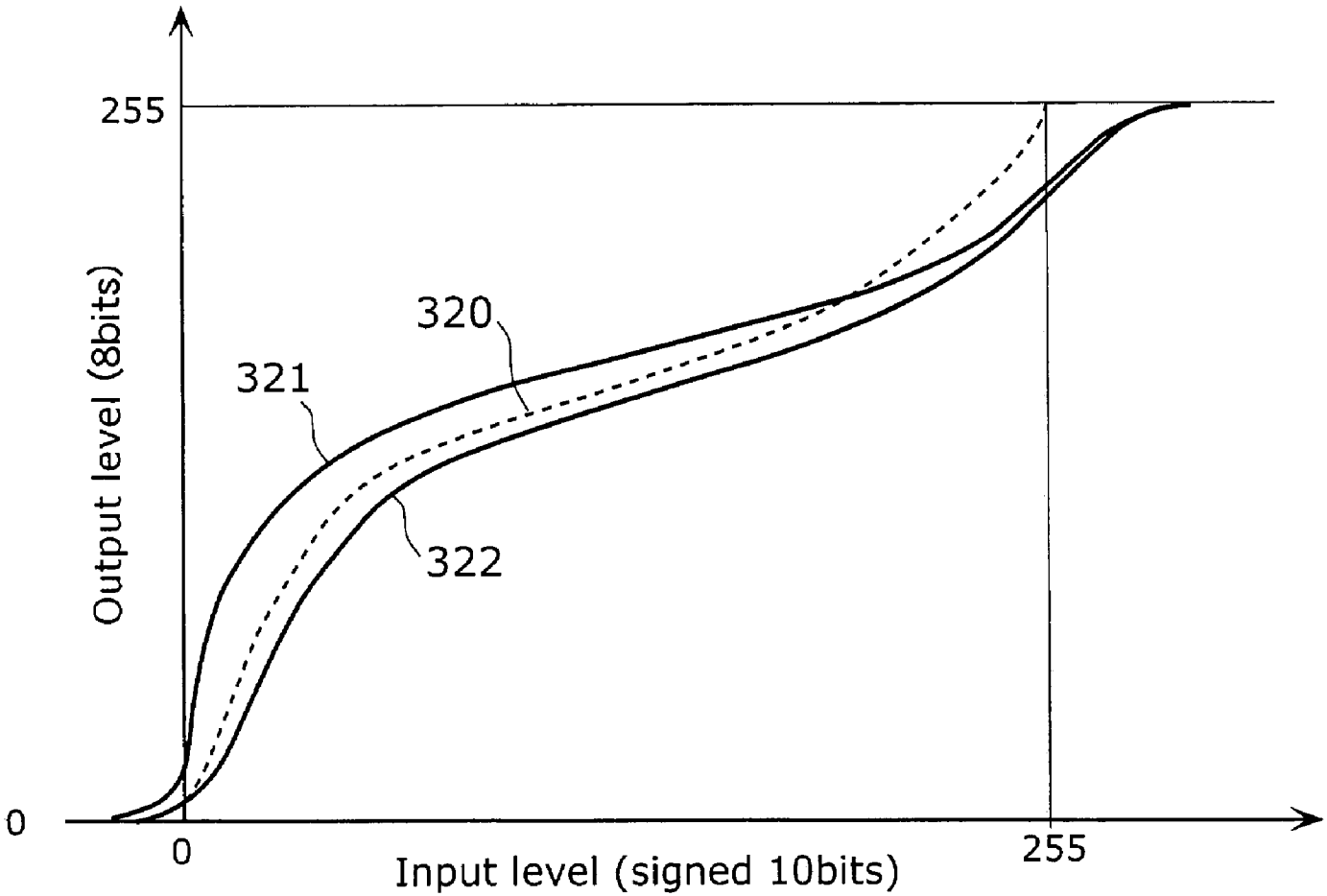
FIG. 10 is a diagram showing an example processing characteristic specified by a gamma correction parameter.

FIG. 10 is a diagram showing an example processing characteristic specified by the gamma correction parameter. This characteristic, which is based on the inverse characteristic of the gamma characteristic of the display device 3 illustrated in FIG. 2, is indicated by a curve 320 represented by a dashed line in FIG. 10. The curve 320 can be obtained by allocating "0" to the lowest brightness level and "255" to the highest brightness level on the Y axis shown in FIG. 2, and then exchanging the X axis with the Y axis.

Since a color enhancement process or a color control process is also performed in the color conversion processing circuit 51 in the present embodiment on the basis of the parameter adjusted to the curve 320, a necessary support is made on the part of the gamma correction circuit 52 and the gamma correction parameter. Output signals of the color conversion processing circuit 51 in the present embodiment are 10-bit parallel data, and therefore, there is a possibility that a value exceeding 255 or a negative value is worked out as a result of the matrix calculation.

Accordingly, as indicated by curves 321 and 322 shown by solid lines in FIG. 10, the following characteristics are to be realized. A characteristic in which an output corresponding to an input value exceeding 255 on the X axis has a gradual saturation characteristic so as to be controlled to 255 at maximum; and a characteristic in which an output corresponding to a negative input value on the X axis has a gradual saturation characteristic so as to be controlled to be 0 or over. In order to support these characteristics, the gamma correction circuit 52, in addition to the configuration of the inverse gamma correction circuit 50 shown in FIG. 5, is configured to input to the control unit 101 sign bits and bits added to higher bits, and add the initiation Y coordinate value and the termination Y coordinate value that add the number of broken lines in the direction of X axis.

Also, in order to improve visibility in dark scenes which are often included in a movie and others, it is also possible to make such a correction to the curve 320 so as to enable an output corresponding to a low input level to be slightly higher, just like the characteristic indicated by the curve 321 shown by the solid line, for example. However, in the case of compressed images such as those compliant with MPEG, for example, there occurs a case where an excessive brightening up of dark scenes results in unsightly block noise in a part of a scene which is supposed to be all black. In order to circumvent this, it is also possible to make such a correction as can control brightness slightly to a lower level, just like the characteristic indicated by the curve 322 shown by the solid line, for example. These characteristics can be easily calculated using a method similar to Expression (3), for example.

The inverse gamma correction parameter, the color conversion parameter, and the gamma correction parameter calculated by the parameter calculating unit 14 of the image processing support device 1 are outputted to the image processing device 2 by the parameter setting unit 15.

In the parameter calculation operation described above, it is necessary to check image quality on a display device to be actually used, in order to obtain a visually satisfactory image through brightness and color control. An operator can compare the variations in the parameters and image quality to be actually displayed on the display device 3 by the parameter calculating unit 14 in FIG. 1 displaying, for such operator, parameter calculation information (e.g., measured values and target values used for parameter calculations, as well as calculation results, values to be obtained in the middle of the calculations) on the operation screen display device 5 via the image signal outputting unit 17 and further transferring the calculated parameters to the image processing device 2 so as to output to the display device 3 an actually processed image signal.

Figure 11:
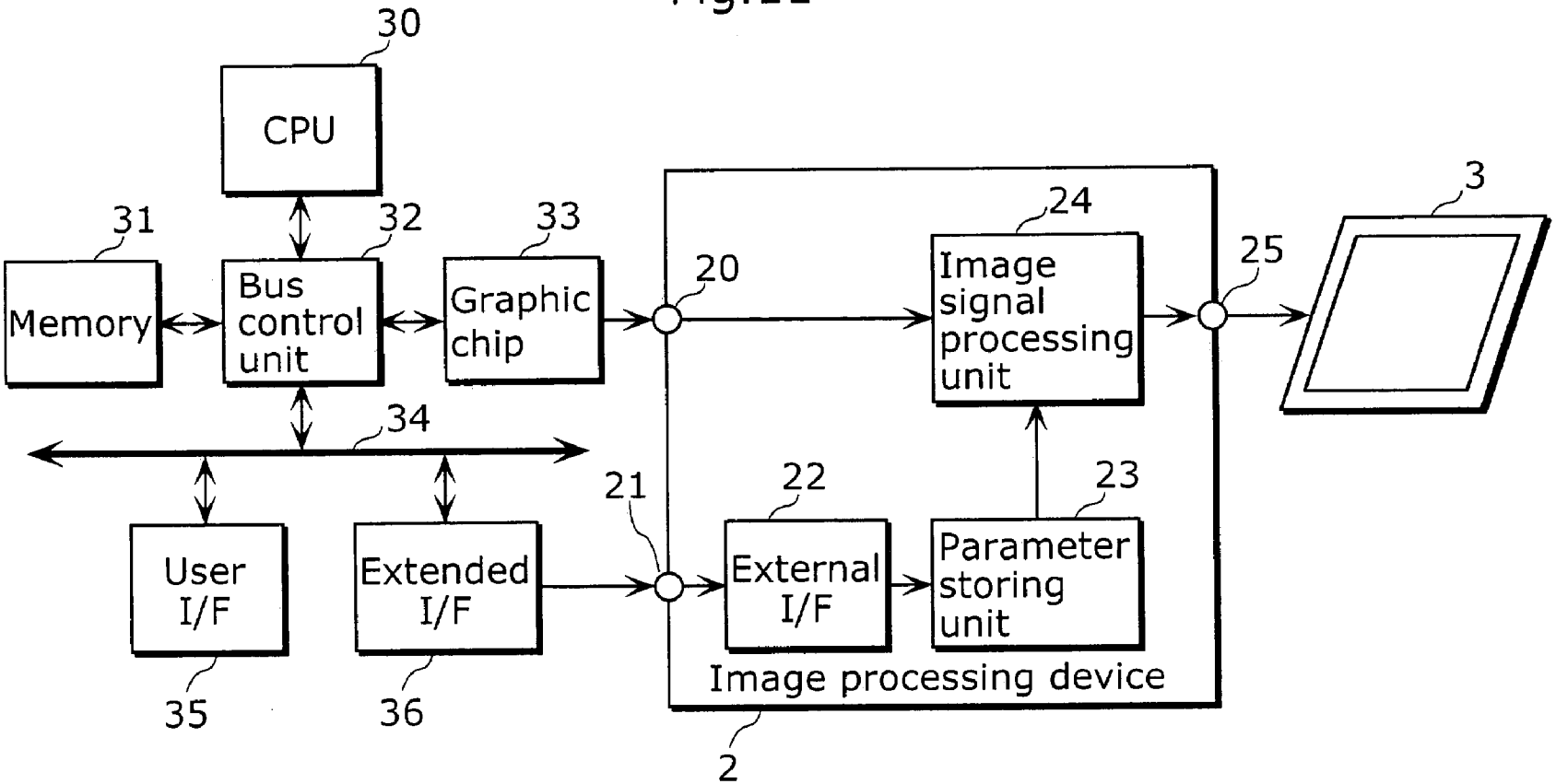
FIG. 11 is a block diagram showing an apparatus which incorporates the image processing device and the display device.

The image processing device 2 for which the parameters are set in the aforementioned manner is embedded into an apparatus used in combination with the display device 3, and produced in quantity. FIG. 11 is a block diagram showing the configuration of a notebook PC which is an example of such apparatus. In FIG. 11, the same numbers are assigned to the same components as those illustrated in FIG. 1, and detailed explanations thereof are omitted.

The notebook PC is comprised of the image processing device 2, the display device 3, a CPU 30, a memory 31, a bus control unit 32, a graphic chip 33, a bus 34, a user interface 35, and an extended interface 36. Note that the above configuration is equivalent to that of a general personal computer, excluding that the image processing device 2 is included.

Graphics generated in the CPU 30 through calculations as well as still/moving images acquired via various kinds of drives and networks (not illustrated in the diagram) connected to the extended interface 36 are outputted to the image processing device 2 via the graphic chip 33. Since the parameter storing unit 23 of the image processing device 2 holds the image processing parameter in the EEPROM 40 and performs processing using parameters which have been appropriately set for the display device 3, it is possible to display on the display device 3 a satisfactory image for which brightness and color control has been performed to suit a specific characteristic of the display device 3.

Figure 12:
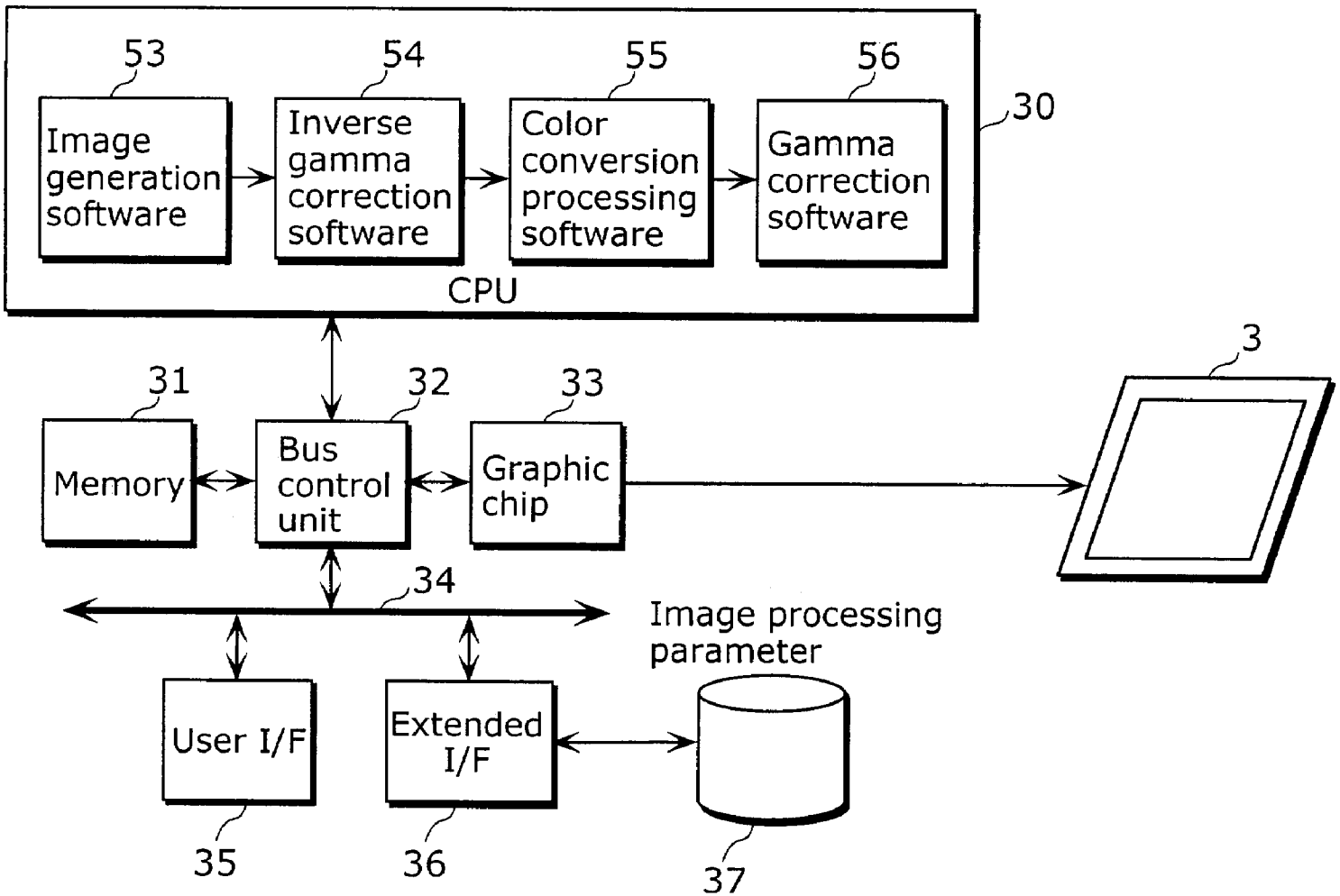
FIG. 12 is a block diagram showing a configuration in a case where all processes in the image processing device are replaced with software processes.

FIG. 12 is a block diagram showing the configuration in the case where all processes performed by the image processing device 2 are replaced with software processes in the configuration of a notebook PC illustrated in FIG. 11. Such notebook PC is equipped with a hard disk drive (to be referred to as "HDD" hereinafter) 37 instead of the image processing device 2. In the CPU 30, image generation software 53, inverse gamma correction software 54, color conversion processing software 55, and gamma correction software 56 are executed. Note that an explanation is provided here on the assumption that the image processing parameter set in the image processing support system is stored in the HDD 37.

Graphics generated by the image generation software 53 on the CPU 30 through calculations as well as still/moving images acquired/decompressed via various kinds of drives and networks connected to the extended interface 36 are transferred to the inverse gamma correction software 54 executed on the same CPU 30. The inverse gamma correction software 54 performs inverse gamma correction to the image signal transferred from the image generation software 53 on the basis of the inverse gamma correction parameter read out from the HDD 37, and transfers such processed image signal to the color conversion processing software 55 executed on the CPU 30. The color conversion processing software 55 performs color conversion for the image signal transferred from the inverse gamma correction software 54 on the basis of the color conversion parameter read out from the HDD 37, and transfers such processed image signal to the gamma correction software 56 executed on the CPU 30. The gamma correction software 56 performs gamma correction for the image signal transferred from the color conversion processing software 55 on the basis of the gamma correction parameter read out from the HDD 37, and outputs such processed image signal to the display device 3 via the graphic chip 33.

When the above-described configuration is employed in the image processing support system for making adjustments to an image processing parameter to suit the display device 3, it is similarly possible to replace the image processing device 2 having the configuration shown in FIG. 1 with pieces of software on a PC. To realize this, the image processing support device 1 is embodied as a PC and pieces of software to be executed on such PC so as to execute the inverse gamma correction software 54, the color conversion processing software 55, and the gamma correction software 56 on the PC. An image processing parameter is prepared in such image processing support system first, and then such image processing parameter which is adjusted to suit the display device 3 is managed and distributed together with the inverse gamma correction software 54, the color conversion processing software 55, and the gamma correction software 56.

In the configuration illustrated in FIG. 12, the image processing parameter is stored in the HDD 37 and a series of processes are performed using parameters which have been appropriately set for the display device 3. As in the case of employing the image processing device 2, it is possible to display on the display device 3 a satisfactory image for which brightness and color control have been performed to suit a specific characteristic of the display device 3. Furthermore, since it is also possible to perform all processes using software, an advantage in terms of both power consumption and an area required for implementing the image processing device can be achieved, and modifications to the contents of image processing can be made without much restraint. Meanwhile, the inverse gamma correction software 54, the color conversion processing software 55, and the gamma correction software 56 can be embodied by simply implementing processes equivalent to those performed in the above-explained hardware as pieces of software.

However, since the inverse gamma correction software 54, the color conversion processing software 55, and the gamma correction software 56 need to be in operation all the time, there arises a problem that a heavy load is placed on the CPU 30 just by displaying screens. Regarding the color conversion processing software 55 in particular, it needs to perform many multiplications, resulting in an enormous amount of processing carried out in the CPU 30. An explanation for a necessary configuration to solve this problem is given below.

Figure 13:
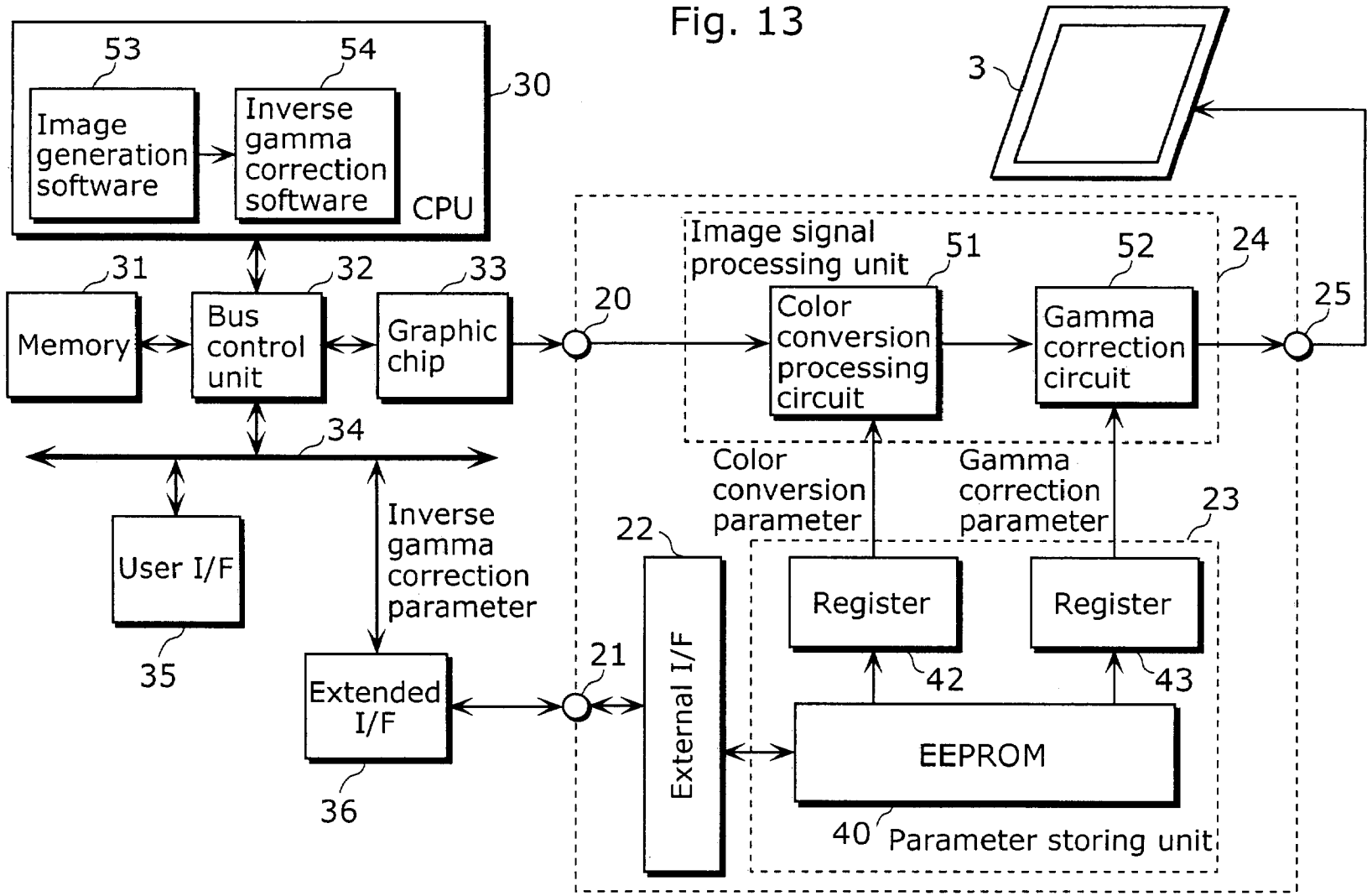
FIG. 13 is a block diagram showing a configuration for performing only an inverse gamma correction process using inverse gamma correction software on a CPU.

FIG. 13 is a block diagram showing a configuration for performing only an inverse gamma correction process out of the processes in the image processing device 2, using the inverse gamma correction software 54 on the CPU 30. Such configuration is achieved not only by eliminating the inverse gamma correction circuit 50 and the register 41 from the configuration of the image processing device 2, but also by storing the inverse gamma correction parameter in the EEPROM 40 so as to allow it to be read out by the inverse gamma correction software 54 via the external interface 22 and the extended interface 36. The above configuration is made possible by transferring the inverse gamma correction parameter read out from the EEPROM 40 using such an interface as a SM bus and a USB as the external interface 22.

The configuration illustrated in FIG. 13 allows the reduction in the scale of image processing device 2 as hardware, as well as visually satisfactory images to be displayed on the display device 3 without placing an enormous amount of processing on the CPU 30, by performing on a dedicated hardware the subsequent processes after color conversion which involve a large amount of processing. Moreover, by allowing the inverse gamma correction parameter to be read out from the EEPROM 40, it is possible to conduct a collective management of the image processing parameter in the EEPROM 40, which consequently facilitates the management of parameters when the image processing device 2 is produced in quantity.

As described above, the present embodiment allows the volume production of display apparatuses which incorporate, together with a display device, an image processing device capable of setting parameters for performing optimal brightness/color correction and enhancement for a display device by using not a DSP, but small-scale dedicated hardware, as well as capable of storing and applying such parameters.

Also, unlike the case where individual end users conduct color management of their own, the present invention allows apparatus manufacturers to supply in quantity image display apparatuses capable of providing visually superior images, utilizing their accumulated expertise about display devices.

Note that although explanations are given for the case where input signals of the display device 3 are 8-bit parallel RGB digital signals, the present invention is not limited to such signals, and image signals in general are also in the scope of application. Also note that the display device 3 is not limited to the liquid crystal display of a notebook PC, and therefore, that the same effect can be achieved by using a general display device such, as a CRT and a PDP.

Moreover, although an explanation is given for the case where 3×3 matrix calculation is employed as a color conversion process, the present invention is not limited to this, and therefore, another color conversion process is also in the scope of application.

As explained above, according to the image processing support system and the image processing device of the present invention, once parameters are set by the image processing support device, the image processing device can carry out signal processing on its own, without requiring the image processing support device to perform the writing of parameters when the power is turned on. Furthermore, since not a DSP, but small-scale dedicated hardware is used, the image processing support system and the image processing device are suited to be incorporated into a portable display device in terms of power consumption and the scale of a device. What is more, the image processing support system and the image processing device according to the present invention are capable of allowing, even when more than one type of display devices are used, each of such display devices to be performed of optimal brightness/color correction and enhancement, as well as allowing volume production of display apparatuses which incorporate such a display device and an image processing device as a set.

What is claimed is:

1. An image processing support system comprising:

an image processing device that includes a nonvolatile parameter storing unit operable to store parameters which are set from outside the image processing device, and an image signal processing unit operable to perform signal processing for changing brightness and colors of an input image signal based on the parameters stored in the nonvolatile parameter storing unit and output the processed image signal;

a display device for displaying the processed image signal outputted from the image processing device;

a measuring device for measuring a gamma characteristic and a color reproduction characteristic as measurement results of the display device; and an image processing support device that includes:

a receiving unit operable to receive the measurement results from the measuring device;

a target characteristic setting unit operable to set a target characteristic inputted from an operator;

an image signal outputting unit operable to output an evaluation image on the display device via the image processing device; and a parameter calculating unit operable to determine a gamma correction characteristic and a color correction characteristic of the display device according to the measurement results received by the receiving unit, prepare the parameters that realize a characteristic in which partial enhancement or partial control is performed for the gamma correction characteristic and the color correction characteristic depending on the target characteristic set by the target characteristic setting unit, and set the prepared parameters in the image processing device.

2. An image processing support system comprising:

an image processing device for performing signal processing for changing brightness and colors of an input image signal based on parameters which are set from outside the image processing device, and outputting the processed image signal to a display device; and an image processing support device for preparing the parameters and setting the prepared parameters in the image processing device, wherein the image processing device includes:

a parameter storing unit operable to store an inverse gamma correction parameter, a color conversion parameter, and a gamma correction parameter which are the parameters set by the image processing support device;

an inverse gamma correcting unit operable to perform an inverse gamma correction process for the input image signal based on the inverse gamma correction parameter so as to reproduce a linear, characteristic:

a color converting unit operable to perform a color space correction, and partial enhancement or partial control of colors for a signal inputted from the inverse gamma correcting unit based on the color conversion parameter, and output a processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from the negative value to the value exceeding the maximum level of the input image signal, based on the gamma correction parameter, and output the processed image signal, and wherein the image processing support device is operable to calculate the gamma correction parameter which enables a high input level to have a saturation characteristic in an output level direction so that the processed image signal output from the gamma correcting unit corresponding to the high input level can be at or below the maximum level of the input image signal, and which realizes a characteristic in which an output level can be positive and gradually changed, the output level corresponding to an input level ranging from a low value to a negative value.

3. An image processing support system comprising:

an image processing device for performing signal processing for changing brightness and colors of an input image signal based on parameters which are set from outside the image processing device, and outputting the processed image signal to a display device; and an image processing support device for preparing the parameters and setting the prepared parameters in the image processing device, wherein the image processing device includes:

a parameter storing unit operable to store an inverse gamma correction parameter, a color conversion parameter, and a gamma correction parameter which are the parameters set by the image processing support device;

an inverse gamma correcting unit operable to perform an inverse gamma correction process for the input image signal based on the inverse gamma correction parameter so as to reproduce a linear characteristic, and perform partial enhancement or partial control of brightness for the input image signal;

a color converting unit operable to perform a color space correction, and partial enhancement or partial control of colors for a signal inputted from the inverse gamma correcting unit based on the color conversion parameter, and output a processed signal indicating a value ranging from a negative value to a value exceeding a maximum level of the input image signal, as an output signal; and a gamma correcting unit operable to perform a correction of a gamma characteristic of the display device for the output signal from the color converting unit which indicates the value ranging from a negative value to a value exceeding the maximum level of the input image signal, based on the gamma correction parameter, and output the processed image signal, and wherein the image processing support device is operable to calculate the inverse gamma correction parameter which realizes a characteristic in which an output level corresponding to a low input level is higher than an output level of an inverse characteristic of a display device characteristic, when calculating the inverse gamma correction parameter, and calculates calculate the gamma correction parameter which enables a high input level to have a saturation characteristic in an output level direction so that the processed image signal output from the gamma correcting unit corresponding to the high input level can be at or below the maximum level of the input image signal.

4. An image displaying device comprising:

a processor for executing software; and an image processing device for performing signal processing for changing brightness and colors of an input image signal based on parameters which are set from outside the image processing device, and outputting the processed image signal to a display device, wherein the processor is operable to perform an inverse gamma correction process for the input image signal using the software, and output the processed signal to the image processing device, and wherein the image processing device includes:

a parameter storing unit operable to store a color conversion parameter and a gamma correction parameter which are the parameters set from outside the image processing device;

a color converting unit operable to perform a color space correction, and partial enhancement or partial control of colors for the signal inputted from the processor based on the color conversion parameter, and output a processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from the negative value to the value exceeding the maximum level of the input image signal, based on the gamma correction parameter, and output the processed image signal to the display device.

5. An image processing device for performing signal processing for changing brightness and colors of an input image signal based on of parameters which are set from outside the image processing device, and outputting the processed image signal to a display device, the image processing device comprising:

a parameter storing unit operable to store an inverse gamma correction parameter, a color conversion parameter and a gamma correction parameter which are the parameters set from outside the image processing device;

a color converting unit operable to perform a color space correction, and partial enhancement or partial control of colors for the input image signal based the color conversion parameter, and output a processed signal indicating a value ranging from a negative value to a value exceeding a maximum level of the input image signal, as an output signal;

a gamma correcting unit operable to perform a correction, and partial enhancement or partial control of a gamma characteristic of the display device for the output signal from the color converting unit which indicates the value ranging from the negative value to the value exceeding the maximum level of the input image signal, based on the gamma correction parameter, and output the processed image signal to the display device; and an external interface unit operable to read the inverse gamma correction parameter from the parameter storing unit and output the readout inverse gamma correction parameter to outside the image processing device.

6. An image processing support system comprising:

an image processing device for performing signal processing for changing brightness and colors of an input image signal based on parameters which are set from outside the image processing device, and outputting the processed image signal to a display device; and an image processing support device for preparing the parameters and setting the prepared parameters in the image processing device, wherein the image processing device includes:

a parameter storing unit operable to store an inverse gamma correction parameter, a color conversion parameter, and a gamma correction parameter which are the parameters set by the image processing support device;

an inverse gamma correcting unit operable to perform an inverse gamma correction process for the input image signal based on the inverse gamma correction parameter so as to reproduce a linear characteristic;

a color converting unit operable to perform a color space correction, and partial enhancement or partial control of colors for a signal inputted from the inverse gamma correcting unit based on the color conversion parameter, and output a processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from the negative value to the value exceeding the maximum level of the input image signal, based on the gamma correction parameter, and output the processed image signal, and wherein the image processing support device is operable to calculate the gamma correction parameter which enables a high input level to have a saturation characteristic in an output level direction so that the processed image signal output from the gamma correcting unit corresponding to the high input level can be at or below the maximum level of the input image signal, and which realizes a characteristic in which a brightness enhancement characteristic for raising an output level corresponding to a low input level is added to an inverse characteristic of a display device characteristic.

7. An image processing support system comprising:

an image processing device for performing signal processing for changing brightness and colors of an input image signal based on parameters which are set from outside the image processing device, and outputting the processed image signal to a display device; and an image processing support device for preparing the parameters and setting the prepared parameters in the image processing device, wherein the image processing device includes:

a parameter storing unit operable to store an inverse gamma correction parameter, a color conversion parameter, and a gamma correction parameter which are the parameters set by the image processing support device;

an inverse gamma correcting unit operable to perform an inverse gamma correction parameter process for the input image signal based on the inverse gamma correction parameter so as to reproduce a linear characteristic;

a color converting unit operable to perform a color space correction, and partial enhancement or partial control of colors for a signal inputted from the inverse gamma correcting unit based on the color conversion parameter, and output a processed signal indicating a value ranging from a negative value to a value exceeding a maximum level of the input image signal, as an output signal; and a gamma correcting unit operable to perform a correction, and partial enhancement or partial control of a gamma characteristic of the display device for the output signal from the color converting unit which indicates the value ranging from the negative value to the value exceeding the maximum level of the input image signal, based on the gamma correction parameter, and output the processed image signal, and wherein the image processing support device is operable to calculate the gamma correction parameter which enables a high input level to have a saturation characteristic in an output level direction so that the processed image signal output from the gamma correcting unit corresponding to the high level can be at or below the maximum level of the input image signal, and which realizes a characteristic in which a low brightness noise control characteristic for lowering an output level corresponding to a low input level is added to an inverse characteristic of a display device characteristic.

* * * * *